United States Patent [19]

DeRoche et al.

[11] Patent Number: 4,814,765

[45] Date of Patent: Mar. 21, 1989

[54] METHOD AND APPARATUS FOR DISPLAYING THE STATUS OF A SYSTEM OF TRAFFIC SIGNALS

[75] Inventors: Robert F. DeRoche, Riverside; James B. Forbes, Placentia, both of Calif.

[73] Assignee: Econolite Control Products, Inc., Anaheim, Calif.

[21] Appl. No.: 65,679

[22] Filed: Jun. 16, 1987

Related U.S. Application Data

[63] Continuation-in-part of Ser. No. 62,146, Jun. 12, 1987, abandoned.

[51] Int. Cl.[4] ..... G08G 1/07; G08G 1/096

[52] U.S. Cl. ..... 340/915; 340/754; 340/911

[58] Field of Search ..... 340/915, 911, 910, 909, 340/753, 754; 364/436

[56] References Cited

U.S. PATENT DOCUMENTS 3,764,972 10/1973 Siklos et al. ..... 340/915
4,167,784 9/1979 McReynolds et al. ..... 340/911 X

OTHER PUBLICATIONS

Obermaier, Anton "The 'Green Wave' Rolls On", IEEE Spectrum, Mar. 1977, pp. 75–78.
The Urban Traffic Control System, 9/74.
Canadian General Electric T-200 Central Computerized Traffic Control System Specification 5/86.
ITE Journal Article: "Connecticut Department of Transporation Computerized Traffic Management System" 8/85.

*Primary Examiner*—Joseph A. Orsino
*Assistant Examiner*—Brian R. Tumm
*Attorney, Agent, or Firm*—Christie, Parker & Hale

[57] ABSTRACT

The status of the traffic signals is repeatedly monitored. A visual display is presented of the spatial arrangement of the traffic signals in the system. The currently monitored status of the traffic signals is repeatedly represented on the display, spatially coordinated with the display of the respective traffic signals. A plurality of previously monitored statuses is also repeatedly represented on the display, spatially coordinated with the respective traffic signals and a traffic speed progression representation therebetween. The display distinguishes between through green and local green traffic signal status. A comparison is made of the currently monitored status of a traffic signal under consideration with the previously monitored status of the adjacent traffic signals as the latter arrives at the traffic signal under consideration and a separately distinguishable mark represents a discrepancy in the comparison when the previously monitored status is through green.

11 Claims, 7 Drawing Sheets

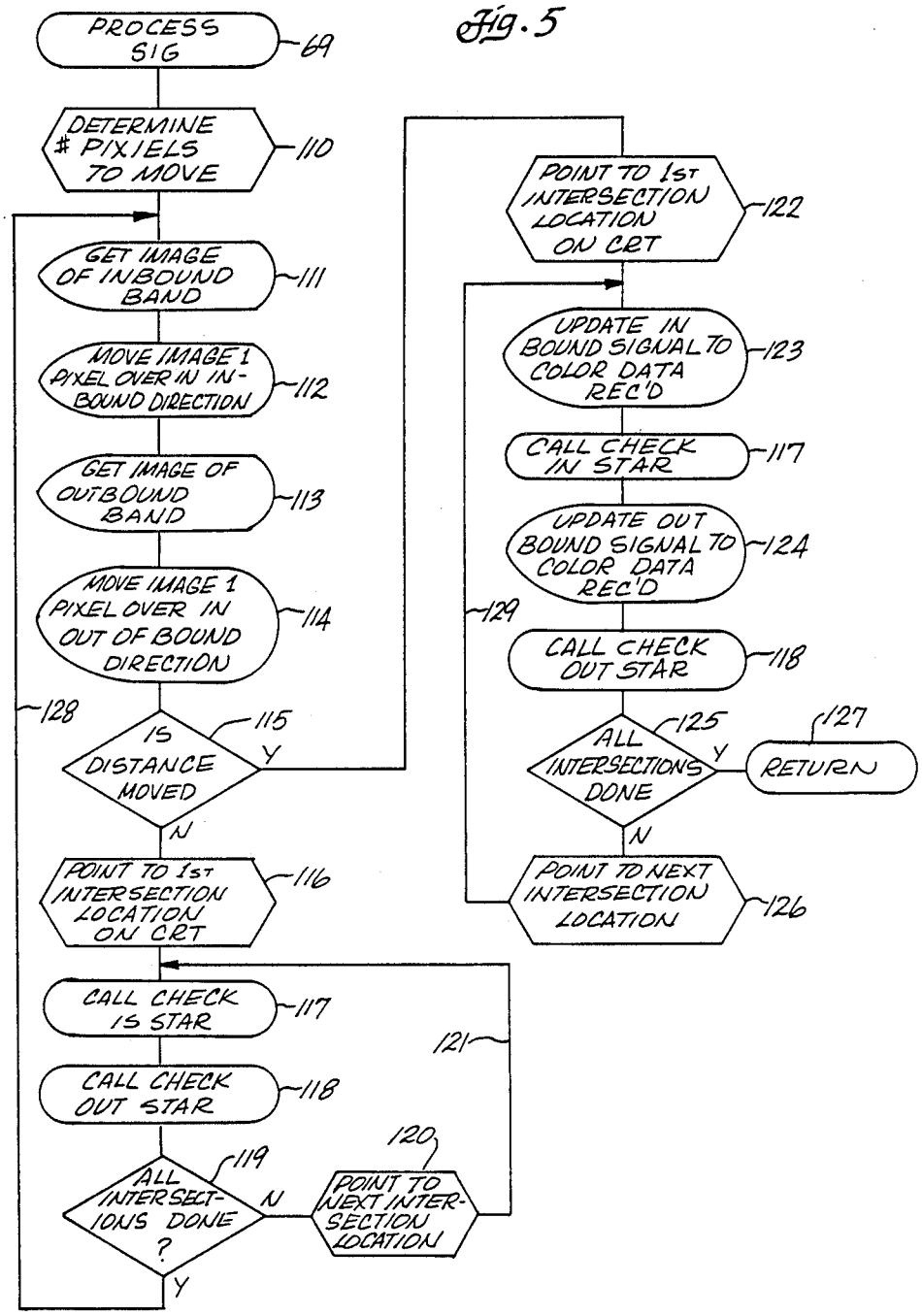
Fig. 5
PROCESS SIG
69
DETERMINE # PIXIELS TO MOVE
110
GET IMAGE OF INBOUND BAND
111
MOVE IMAGE 1 PIXEL OVER IN IN-BOUND DIRECTION
112
GET IMAGE OF OUTBOUND BAND
113
MOVE IMAGE 1 PIXEL OVER IN OUT OF BOUND DIRECTION
114
128
IS DISTANCE MOVED
115
Y
N
POINT TO 1ST INTERSECTION LOCATION ON CRT
116
CALL CHECK IS STAR
117
121
CALL CHECK OUT STAR
118
ALL INTERSECTIONS DONE ?
119
N
Y
POINT TO NEXT INTERSECTION LOCATION
120
POINT TO 1ST INTERSECTION LOCATION ON CRT
122
UPDATE IN BOUND SIGNAL TO COLOR DATA REC'D
123
CALL CHECK IN STAR
117
UPDATE OUT BOUND SIGNAL TO COLOR DATA REC'D
124
129
CALL CHECK OUT STAR
118
ALL INTERSECTIONS DONE
125
Y
N
RETURN
127
POINT TO NEXT INTERSECTION LOCATION
126

METHOD AND APPARATUS FOR DISPLAYING THE STATUS OF A SYSTEM OF TRAFFIC SIGNALS

CROSS-REFERENCE TO RELATED APPLICATIONS

This is a continuation-in-part of Ser. No. 062,146, filed June 12, 1987, now abandoned.

This specification incorporates a microfiche appendix comprising a total number of 1 microfiche and a total number of 53 frames.

BACKGROUND OF THE INVENTION

This invention relates to roadway traffic control and, more particularly, to a method and apparatus for displaying the status of a system of traffic signals.

A time-space diagram is used by traffic engineers to design timing plans in an coordinated arterial traffic control system. Such a time-space diagram is a two-dimensional graph representing distance along the arterial in the horizontal coordinate and time in the vertical coordinate. Vertical traffic signal interval bands are drawn on the distance coordinate at the signalized intersections. Across the graph is drawn a horizontal working line on which the green or red phase of each traffic signal interval band is centered. A traffic progression speed line which has a slope representing the desired progression speed through the arterial is drawn with an origin at the beginning of the green phase of the first intersection in the system. For each succeeding intersection, either a red or green signal phase is centered on the horizontal working line to obtain an equal band width for each direction of flow.

Computer programs have been developed to reduce the expenditure of labor on, and to improve the accuracy of, timing plan designs.

A number of computer controlled graphic displays have been used to date to represent wide area traffic control conditions. One such graphic display is a static time-space representation of the cycle at each intersection, corrected for travel time to eliminate the need for proportional spacing of intersections. Another graphic display is a static representation of traffic density throughout a system in time and distance; the result is a platoon progression diagram showing the traffic distribution in the system as a function of time. A third graphic display dynamically represents the status of traffic signals in a system; the traffic signals are represented on the display at positions spatially coordinated with the signalized intersections and the traffic signal representations on the display change color as the traffic signals sequence through their cycle.

SUMMARY OF THE INVENTION

The invention presents a display of current status of a system of traffic signals and a plurality of previous statuses of such traffic signals. Specifically, the status of the traffic signals is repeatedly monitored. A visual display is presented of the spatial arrangement of the traffic signals in the system. The currently monitored status of the traffic signals is repeatedly represented on the display, spatially coordinated with the display of the respective traffic signals. A plurality of previously monitored statuses is also repeatedly represented on the display, spatially coordinated with the display of the respective traffic signals and a traffic progression speed representation therebetween. The described display permits observation of the flow of traffic at the progression speed approaching the signalized intersections of the system and deviations from coordinated operation.

A feature of the invention is a display that distinguishes between through green and local green traffic signal status. As used herein, the term "through green", refers to the portion of the green interval of a traffic signal that corresponds to the through-band of a coordinated system and the term "local green" refers to the portion of the green interval of the traffic signal lying outside of the through-band. The breakdown of traffic signal status between through green and local green presents a dynamic display of the through green band advancing from intersection to intersection in the system at the designed progression speed. This permits the observer to make a more thorough analysis of the system, detecting the deviations from coordinated operation and assessing side street demand.

Another feature of the invention is making a comparison of the currently monitored status of a traffic signal under consideration with the previously monitored status of the adjacent traffic signal as the latter arrives at the traffic signal under consideration and representing as a separately distinguishable mark a discrepancy in the comparison, i.e., the previously monitored status is through green and the currently monitored status is not. This facilitates observation of deviations from coordinated operation.

Preferably, the traffic signals are represented on the display as marks in a horizontal row; The currently monitored status of the traffic signals is represented by the color of the marks; and the previously monitored statuses are represented adjacent to the row as a three colored horizontal band that moves between the marks in a given direction at a speed proportional to the designed progression speed for the system.

BRIEF DESCRIPTION OF THE DRAWINGS

The features of a specific embodiment of the best mode contemplated of carrying out the invention are illustrated in the drawings, in which:

FIGS. 3 to 6 are flow diagrams describing a computer program for generating the display of FIGS. 2A to 2H.

DETAILED DESCRIPTION OF THE SPECIFIC EMBODIMENT

Figure 1:
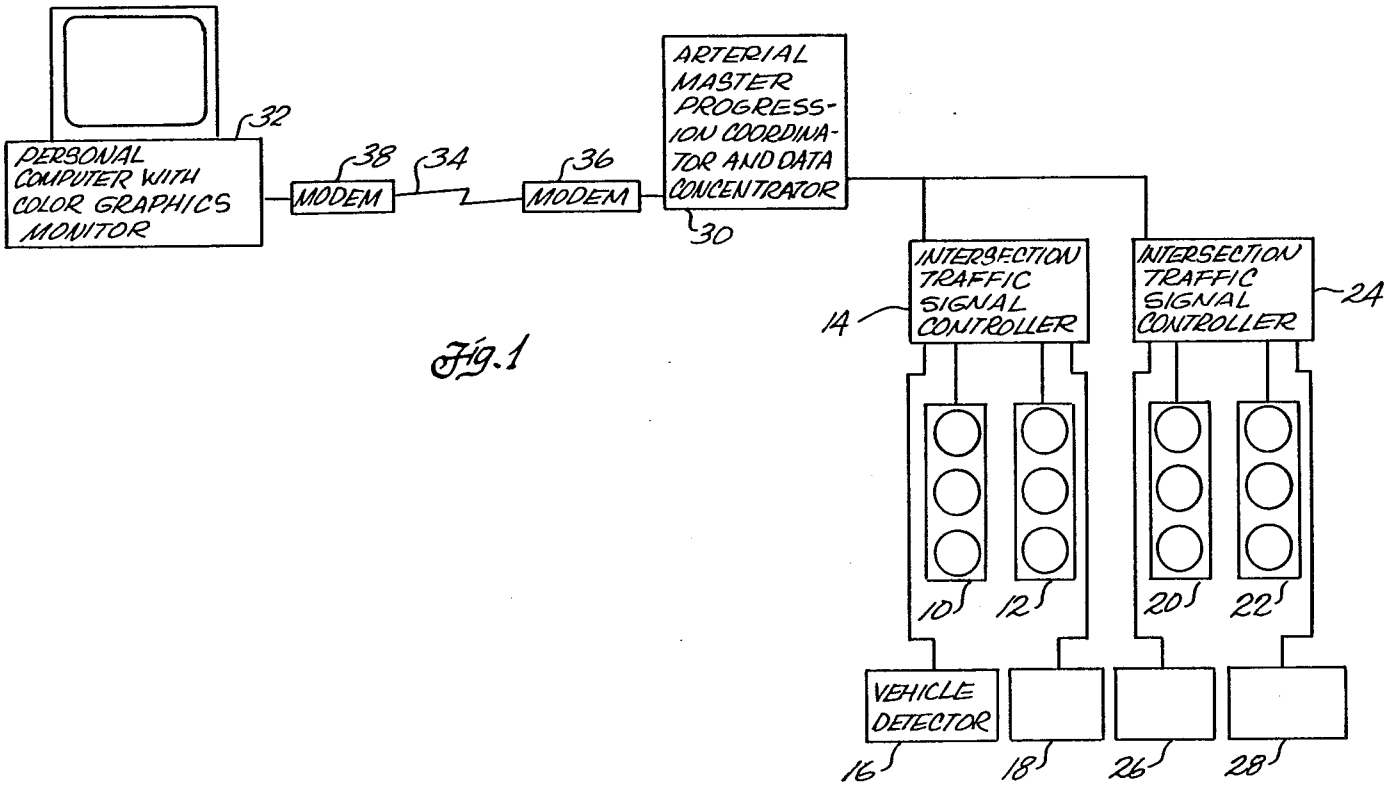
FIG. 1 is a schematic block diagram of a coordinated system of traffic signals, including apparatus for displaying status.

In FIG. 1, a system of traffic signals is distributed at the intersections of a traffic artery subject to traffic control. At one intersection, signal heads 10 and 12 are controlled by an intersection traffic controller 14, in partial response to local traffic conditions sensed by vehicle detectors 16 and 18. More or fewer signal heads and vehicle detectors than shown could be employed. Similarly at another intersection of the artery, signal heads 20 and 22 are controlled by an intersection traffic signal controller 24 in partial response to local traffic conditions sensed by vehicle detectors 26 and 28. Similar signal heads, vehicle detectors and controllers would be provided at each intersection of the artery. Controllers 14, 24, etc. are coupled to an arterial master progression coordinator and data concentrator 30 located near the artery, which supervises and synchronizes their operation, setting the traffic signal intervals for coordinated operation.

A personal computer 32, having a color monitor with color graphics capability is remotely located with respect to the traffic artery. To transmit data from coordinator and concentrator 30 to personal computer 32, a communication link is established via a telephone line 34 and interfacing modems 36 and 38.

Coordinator and concentrator 30, in conjunction with controllers 14, 24, etc., repeatedly monitors the status of the traffic signals of the system at regular sampling intervals, e.g., one sample per second, and transmits digital signals representative of such status through telephone line 34 to personal computer 32. The equipment illustrated in FIG. 1 is all conventional. The invention is implemented by programming computer 32 to carry out the functions and generate the visual displays described below.

Reference is made to FIGS. 2A to 2H for a description of the visual display represented on the screen of personal computer 32 at different times of the cycle of the system. A horizontal line 40 represents the arterial. Vertical slash marks S-1, S-2, S-3 and S-4 are arranged in a row along line 40 to represent the traffic signals in the system. Their spacing corresponds to the relative spacing between the signalized intersections along the arterial. Thus, the visual display presents the spatial arrangement of the traffic signals in the system. The current status of each of the traffic signals is represented by the color of marks S-1 to S-4. One color is displayed during the red and yellow intervals, another color is displayed during the through green interval and a third color is displayed during the local green interval. By way of example, these colors could be red (no cross-hatching) dark green (cross-hatching moving from lower left to upper right), and light green (cross-hatching moving from upper left to lower right), respectively.

Thus, the current statuses of the traffic signals are repeatedly represented on the screen by the colors of marks S-1 to S-4, which spatially coordinates the status of the traffic signals with the display of the respective traffic signals. (A yellow interval is treated as red for the following description of the invention.)

Horizontal bands 42 and 44 are displayed on the screen adjacent to line 40. Band 42, which lies above line 40, displays one of three colors representing previously monitored statuses of traffic signals S-1 to S-4 moving from right to left, designated the inbound direction. Band 44, which lies below line 40, displays one of three colors representing previously monitored statuses of traffic signals S-1 to S-4 moving from left to right, designated the outbound direction. Exemplary colors are the same as S-1 to S-4. (As an exception, however, it is assumed the red interval is displayed as black, instead of red.)

The current status is repeatedly updated at the sampling interval, which for discussion is assumed to be one second. In addition to being displayed on line 40, the current status is also displayed directly above and below the traffic signals in bands 42 and 44. At the next sampling interval, when a new current status is displayed on line 40, the status displayed in bands 42 and 44 is shifted to the left in the case of band 42 and to the right in the case of band 44. This process is repeated at each sampling interval, the current status being represented in bands 42 and 44 directly above and below the traffic signal and the previously monitored statuses being shifted in the direction of traffic flow i.e. to the left in the case of band 42 and to the right in the case of band 44. The previous statuses in bands 42 and 44 are shifted until they reach the next adjacent intersection, where they are replaced by the statuses of the traffic signal there. The rate at which the previously monitored statuses are shifted relative to the distance between marks on the screen is proportional to the designed progression speed through the system. In other words, the ratio of the amount of shift from one sampling interval to another over the distance between marks on line 40 equals the ratio between the distance that a vehicle travels on the arterial during the sampling interval over the distance between the traffic signals represented by the two marks. For example, assume that a distance of 4,000 feet is to be represented on the display, a 3,000 foot arterial with 500 feet additional on either end and four intersections spaced 1,000 feet apart. If the computer monitor displays 640 pixels per line, and the designed progression speed through the arterial is forty-four feet per second (thirty miles per hour), the prior statuses represented in bands 42 and 44 shift at a rate of 7.04 pixels per second. In practice, the shift would be seven pixels per second until the fraction accumulates into a whole pixel, at which time the next shift is eight pixels. As a result, the display represents a plurality of previously monitored statuses spatially coordinated with the respective traffic signals and the progression speed therebetween.

Figure 2A:
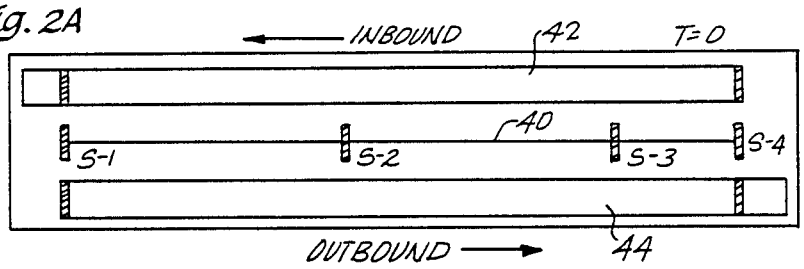
FIGS. 2A to 2H are diagrams illustrating a typical display incorporating principles of the invention.

First, the display on the screen will be considered for inbound traffic during a typical cycle of the system. As illustrated in FIG. 2A, at time zero, marks S-1 and S-4 are through green and marks S-2 and S-3 are red. The same colors appear directly above marks S-1 to S-4 in band 42.

Figure 2B:
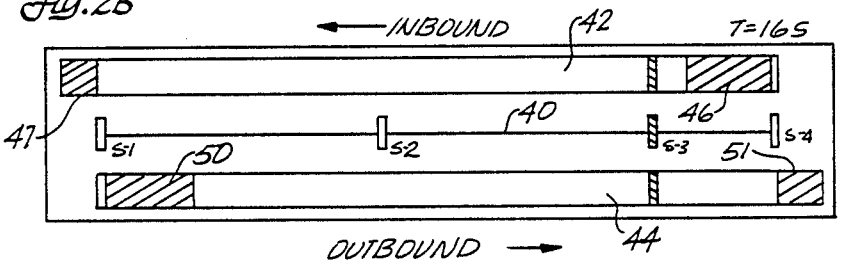

As depicted in FIG. 2B, at time sixteen seconds into the cycle marks S-1 and S-4 change back to red and mark S-3 makes an early return to green, i.e., a local green. Assuming a sampling interval of one second, sixteen prior statuses are represented in band 42, i.e. the statuses from time zero to time fifteen seconds. The result is a through green bar 46 and a through green bar 47, the latter being truncated because it extends beyond the left hand end of band 42. The left hand portion of bar 46 represents mark S-4 at time zero and the right hand portion of bar 46 represents mark S-4 fifteen seconds into the cycle. The intermediate portions of bar 46 represent mark S-4 at corresponding intermediate times between zero and fifteen seconds.

Figure 2C:
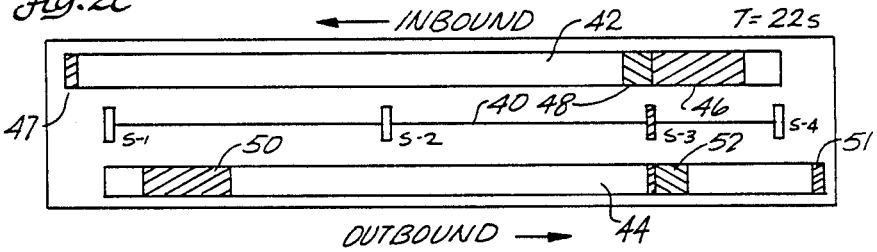

As depicted in FIG. 2C, at time twenty-two seconds into the cycle mark S-3 changes to through green in synchronism with the arrival of bar 46 and leaves behind a local green bar 48. The left hand portion of bar 48 represents mark S-3 sixteen seconds into the cycle and the right portion of bar 48 represents mark S-3 twenty-one seconds into the cycle.

Figure 2D:
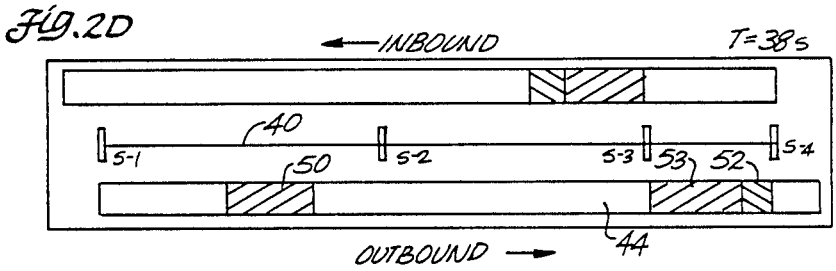

As depicted in FIG. 2D, at time thirty-eight seconds into the cycle, mark S-3 changes to red in synchronism with the departure of bar 46. Thus, bar 46 now represents the previous statuses of mark S-3 from time twenty-two seconds to time thirty-eight seconds, although it appears unchanged to the human eye as it passes mark S-3, because the traffic signals represented by marks S-3 and S-4 are changing in synchronism. Actually, as bar 46 passes mark S-3, the portion of bar 46 to the right of mark S-3 represents the previous statuses of mark S-4 and the portion of bar 46 to the left of mark S-3 represents the prior statuses of mark S-3.

Figure 2E:
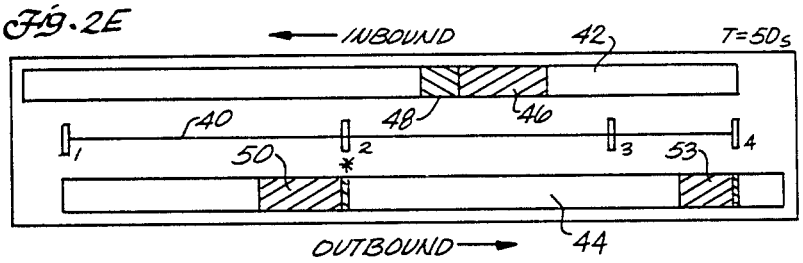

As depicted in FIG. 2E, at time fifty seconds into the cycle, bars 46 and 48 have progressed further along band 42 in an inbound direction between marks S-3 and S-2.

Figure 2F:
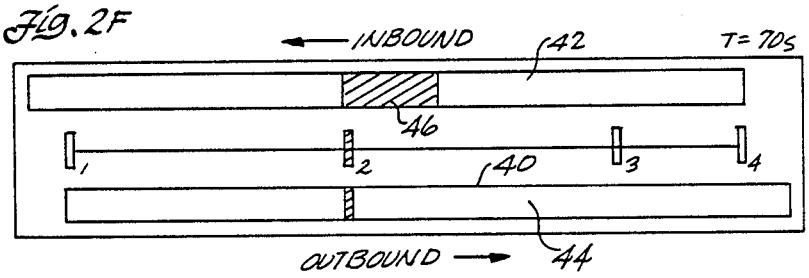

As depicted in FIG. 2F, at time seventy seconds into the cycle, mark S-2 changes to through green in synchronism with the arrival of bar 48.

Figure 2G:
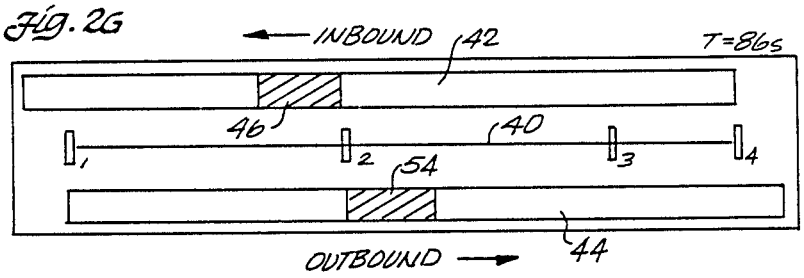

As depicted in FIG. 2G, at time eighty-six seconds into the cycle, mark S-2 changes back to red in synchronism with the departure of bar 46.

Figure 2H:
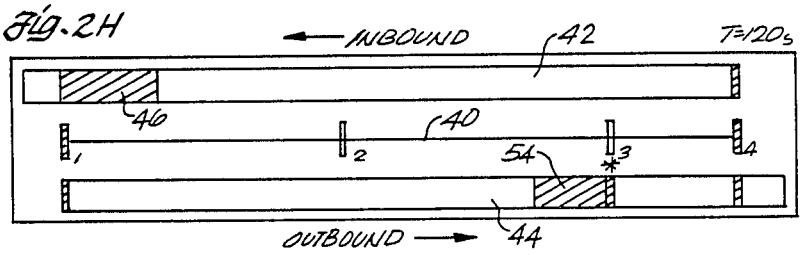

As depicted in FIG. 2H, at time one hundred twenty seconds into the cycle, marks S-1 and S-4 change to through green and the cycle repeats. To summarize the representation of inbound traffic during the cycle, bar 46 was generated at the beginning of the cycle and moved across band 42 from right to left in synchronism with the through green intervals of the traffic signals. One of the traffic signals, represented by mark S-3, also had a local green interval.

Next, the display on the screen will be considered for outbound traffic during the same cycle. As depicted in FIG. 2A, at time zero, marks S-1 and S-4 are through green and marks S-2 and S-3 are red. The same colors appear directly below marks S-1 to S-4 in band 44.

As illustrated in FIG. 2B, at time sixteen seconds into the cycle, marks S-1 and S-4 change back to red and mark S-3 makes an early return to green. The result is a through green bar 50 and a through green bar 51, the latter being truncated because it extends beyond the right hand end of band 44. The right hand portion of bar 50 represents mark S-1 at time zero, and the left hand portion of bar 50 represents mark S-1 fifteen seconds into the cycle. The intermediate portions of bar 50 represent mark S-1 at corresponding intermediate times between zero and fifteen seconds.

As depicted in FIG. 2C, at time twenty-two seconds into the cycle, mark S-3 changes to through green and leaves behind a local green bar 52.

As depicted in FIG. 2D, at time thirty-eight seconds into the cycle, mark S-3 changes to red. The result is a through green bar 53 equal in length to bar 50.

As depicted in FIG. 2E, at time fifty seconds into the cycle, marks S-2 and S-4 are red, as bars 50 and 53 arrive thereat, which indicates the system is not coordinated according to plan. This fact is represented on the display by a separately distinguishable mark, e.g., a star, between the traffic signal representative mark, e.g., S-2 or S-4, and band 44. (Although the star is illustrated between line 40 and the band, it could be located elsewhere in relation to the marks, e.g., above or below the applicable band.) The star remains on the display so long as a through green bar is directly adjacent to a traffic signal representative mark that is red or local green. For each sampling interval, the currently monitored status of each traffic signal is compared with the previously monitored status represented in the band (42 or 44) directly adjacent to the mark representing such traffic signal. If this comparison indicates that the previous status is through green while the current status is not through green, i.e., red or local green, the star is generated and displayed. As used herein, the term "discrepancy in the comparison" refers to this condition. For all other conditions no star is displayed responsive to the comparison.

As depicted in FIG. 2F, at time seventy seconds into the cycle, mark S-2 changes to through green. Prior thereto as bar 50 approached mark S-2, it was extinguished by the red status of mark S-2. The star was previously extinguished at time sixty-five seconds with the total extinguishment of bar 50.

As depicted in FIG. 2G, at time eighty-six seconds into the cycle, mark S-2 changes back to red which ends another through green bar 54.

As depicted in FIG. 2H, at time one hundred twenty seconds into the cycle, marks S-1 and S-4 change to through green and the cycle repeats. Through green band 54 also arrives at mark S-3 which is red, and results in the display of another star until bar 54 is extinguished. In summary, although the traffic signals of the system are properly coordinated for inbound traffic, they are not properly coordinated for outbound traffic. This fact becomes apparent to an observer of the display. An adjustment in the timing plan is indicated to achieve coordinated operation in both directions.

By distinguishing between through green and local green, the display permits the observer to disregard the effects of local traffic in determining whether the system is coordinated. It also permits the observer to ascertain when side street demand occurs; for example, a local green bar leading a through green bar indicates an early return to green at the intersection and a lagging local green bar indicates an absence of current demand on the side street. By observing the local green bars the traffic engineer can also gain insight into possibly better timing plans to move the traffic through the system. For example, if no local green or very little local green is displayed, heavy side street traffic is indicated, which suggests the possibility of reducing the length of the through green band. On the other hand, consistent appearances of local green bars throughout the system suggests that a longer through green band might be called for.

Reference is made to FIGS. 3, 4, 5 and 6 for a flow diagram of a computer program for implementing the invention. Parallelogram shaped blocks, such as a block 60, represent input steps. Hexagonal blocks, such as a block 61, represent process steps. Pentagonal blocks, such as a block 62 represent the step of writing data to the monitor (cathode ray tube) of the computer. Diamond shaped blocks, such as a block 63, represent decision steps. Rectangular blocks, such as a block 67, represent preparatory steps. Ovals, such as a block 69, represent a branching step to a new routine.

Figure 3:
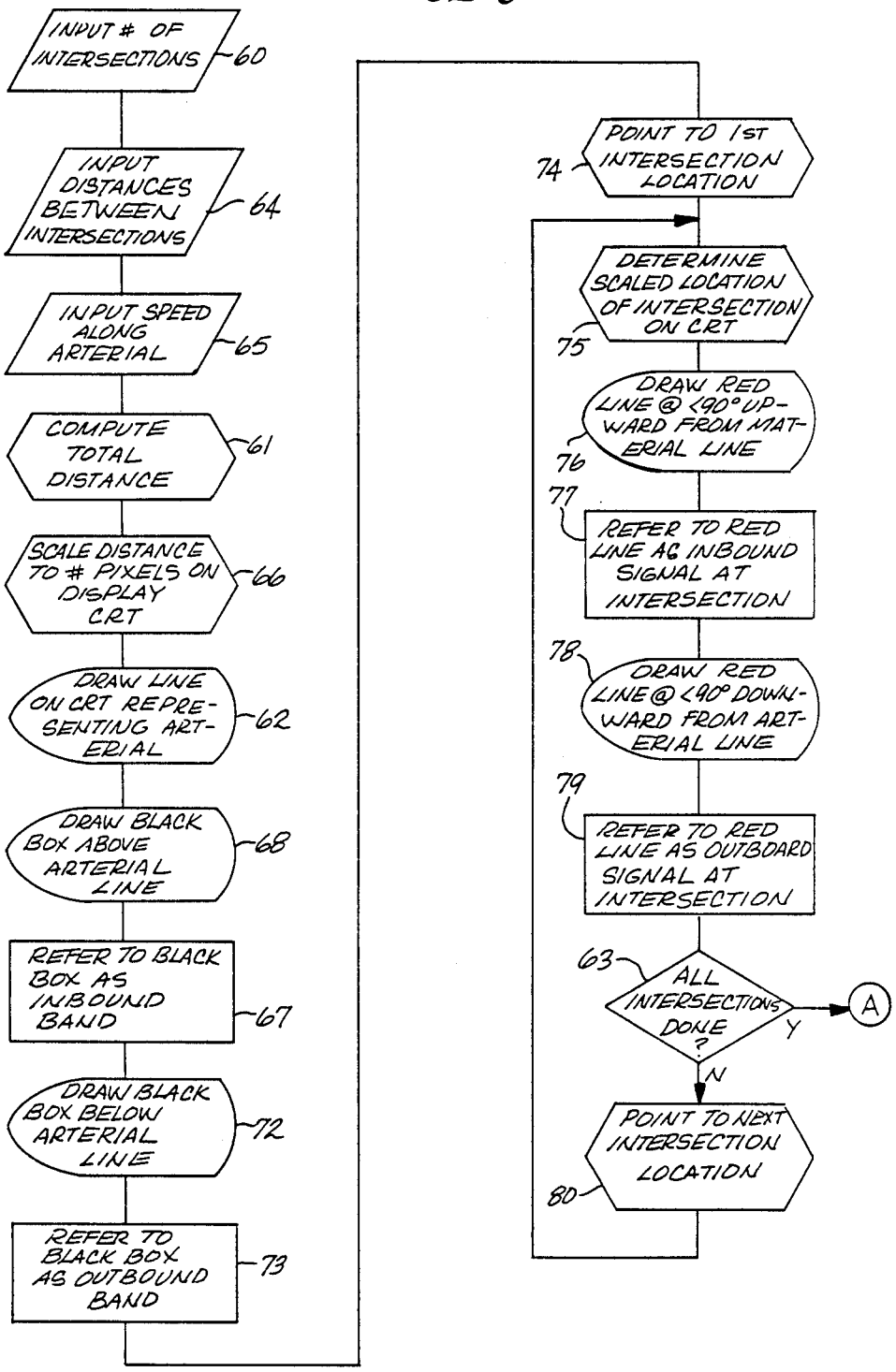

FIG. 3 illustrates the set-up routine. As represented by block 60, the number of intersections is keyed into the computer. As represented by a block 64, the distances between intersections are keyed into the computer. As represented by a block 65, the designed progression speed along the arterial is keyed into the computer. As represented by block 61, the total distance along the arterial to be represented on the display is computed. As represented by block 66, this distance is then scaled to the number of pixels on the display. As represented by box 62, an arterial line, i.e., line 40 in FIG. 2, is then drawn on the display. As represented by blocks 67 and 68, a black band, i.e., band 42 in FIG. 2, is drawn above the arterial line and labeled "inbound band". As represented by blocks 72 and 73, a black band, i.e., band 44 in FIG. 2 is drawn below the arterial line and labeled "outbound band". As represented by a block 74, the first intersection is selected. As represented by a block 75, the scaled location of the selected intersection is located on the display. As represented by blocks 76 and 77, a red vertical line representing the traffic signal at the selected intersection is drawn upwardly from the arterial line and labeled "inbound signal". As represented by blocks 78 and 79, a red vertical line representing the traffic signal at the selected intersection is drawn downwardly from the arterial line and labeled "outbound signal". As represented by a block 63, a determination is made as to whether all the intersections have been selected; if not, as represented by a block 80, the next intersection is selected and the process is repeated until all the intersections have been selected.

Figure 4:
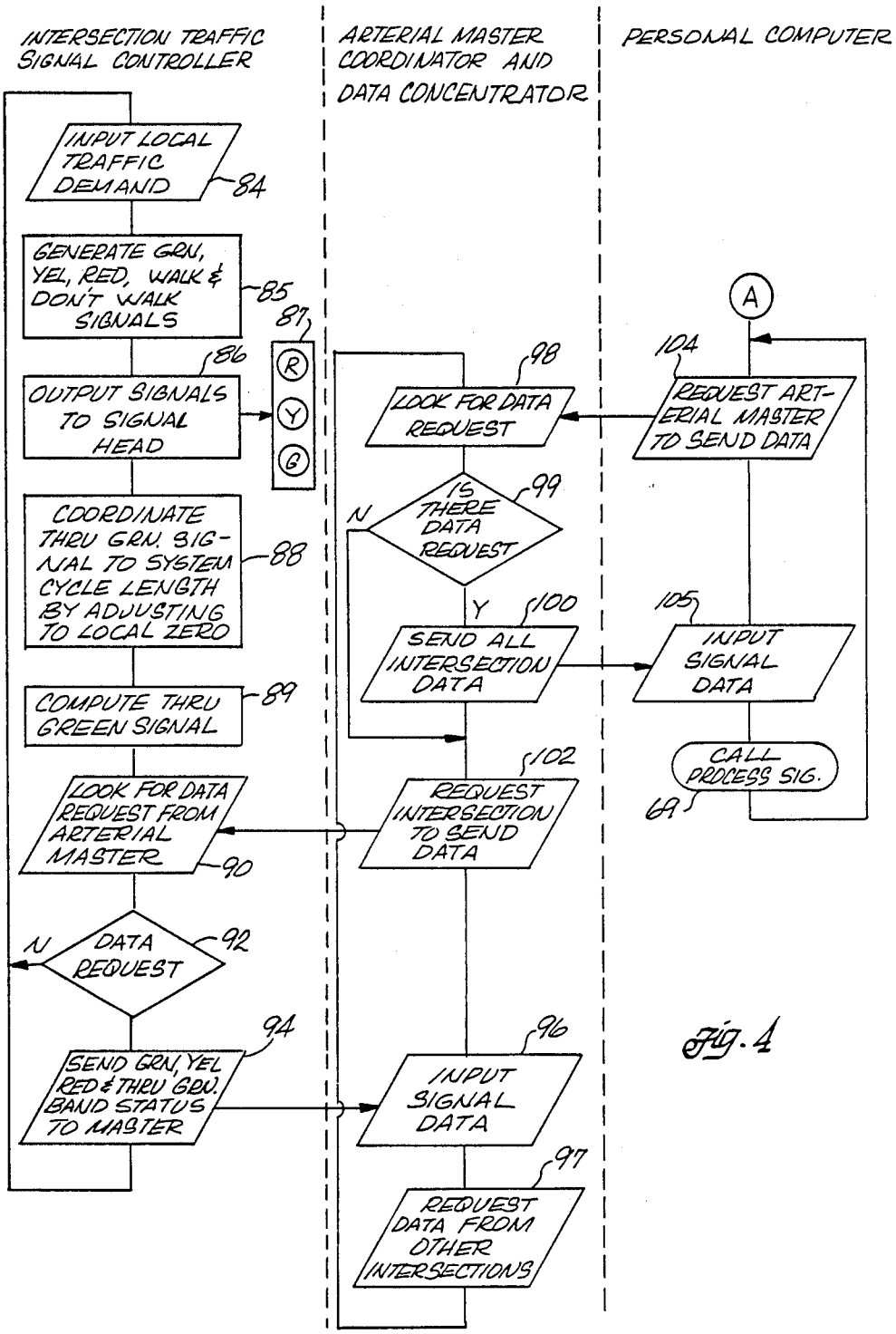

After all the intersections have been selected, the process shifts to the functions depicted in FIG. 4, which are executed by conventional computer programs associated with the apparatus depicted in FIG. 1. The functions associated with each intersection controller, e.g., 14 or 24, are depicted to the left of a vertical line 82. The functions associated with personal computer 32 are depicted to the right of a vertical line 83. The functions associated with coordinator and concentrator 30 are depicted between lines 82 and 83. As represented by a block 84, the local traffic demand as sensed, for example, by loop detectors, is inputed to the intersection controller. As represented by a block 85, the intersection controller generates the signals for controlling the traffic signals at the intersection, which as represented by a block 86 are coupled to the traffic signals at the intersection represented by a block 87. As represented by blocks 88 and 89, the phasing in the cycle and length of the through green signal at the intersection is determined in conjunction coordinator and concentrator 30. As represented by a block 90, a determination is made as to whether data is requested from the coordinator and concentrator. As represented by blocks 92 and 94, if a request is pending, the traffic signal status data is transmitted to the coordinator and concentrator. Whether or not a request is pending, the signal data is recycled to update the traffic signal intervals in view of the local traffic demand.

As represented by a block 96, the status data from the intersection controller under consideration is received by coordinator and concentrator 30 (FIG. 1). As represented by a block 97, the traffic signal status data is received from the remaining intersection controllers. As represented by a block 98, it is determined whether a request for status data is pending from computer 32. As represented by blocks 99 and 100, if such a request is pending, status data from all the intersections is transmitted to computer 32. As represented by a block 102, in either case a request for updated status data is then sent to each intersection controller and the described process is repeated.

As represented by a block 104, requests for status data from coordinator and concentrator 30 are issued by computer 32. As represented by a block 105, the requested status data transmitted by coordinator and concentrator 30 is then received by computer 32. As represented by a block 69, a routine is then called to process the requested status data and generate the electrical signals required to present the visual display of status on the screen of computer 32. The steps represented by blocks 104, 105, and 106 are repeated at one second intervals.

FIG. 5 illustrates the process and signal generation routine. As represented by a block 110, the number of pixels to move for each data sample is determined based upon the designed progression speed, the sample interval and the scaled distances between intersections. As represented by a block 111, the image of the inbound band is fetched from the monitor. As represented by a block 112, the image of the inbound band is shifted one pixel in the inbound direction. As represented by blocks 113 and 114, these steps are repeated with respect to the outbound band. As represented by a block 115, a determination is made as to whether the shifting of image data has been completed. If it has not, as represented by a block 116, the first intersection is selected. As represented by blocks 117 and 118, the program branches to "check-in star" and "check-out star" routines. As described in more detail below in connection with FIG. 6, these routines compare the previous statuses in display bands 42 and 44 with the current status at the intersection, generate a star on the display if a discrepancy in the comparison results when the previous status is through green and updates the status in the display bands adjacent the intersection. As represented by a block 119, it is determined whether all the intersections have been selected. If not, as represented by a block 120, the next intersection is selected and the "check-in star" and "check-out star" routines are repeated. Blocks 117 to 120 form a loop 121. When all the intersections have been selected, the steps represented by blocks 111 through 120 are repeated until the previous status data has been shifted the prescribed number of pixels, e.g., seven or eight, per sampling interval. Blocks 111 to 116 with loop 121 form a loop 128. Then, as represented by a block 122, the first intersection is again selected. As represented by a block 123, the inbound mark on the display representative of the intersection is updated to reflect the current status of the traffic signal with the data transmitted from coordinator and concentrator 30 (FIG. 1), as represented by block 100 (FIG. 4). As represented by block 117, the "check-in star" routine is then executed.

As represented by a block 124, the outbound mark on the display representative of the intersection is updated to reflect the current status of the traffic signal with the data transmitted from coordinator and concentrator 30 (FIG. 1), as represented by block 100 (FIG. 4). As represented by block 118, the "check-out star" routine is then executed. As represented by a block 125, the determination is made as to whether all the intersections have been selected. If not, as represented by a block 126, the next intersection is selected and the process is repeated until all the intersections have been selected. Blocks 123 to 126 with blocks 117 and 118 form a loop 129. Then, a return is made to the beginning of the routine, as represented by a block 127, and the process is repeated starting at block 104. Assuming a shift of seven pixels per sampling interval and four intersections as disclosed, loop 121 is executed twenty-four times per sampling interval, loop 128 is executed seven times per sampling interval, and loop 129 is executed four times per sampling interval.

Figure 6:
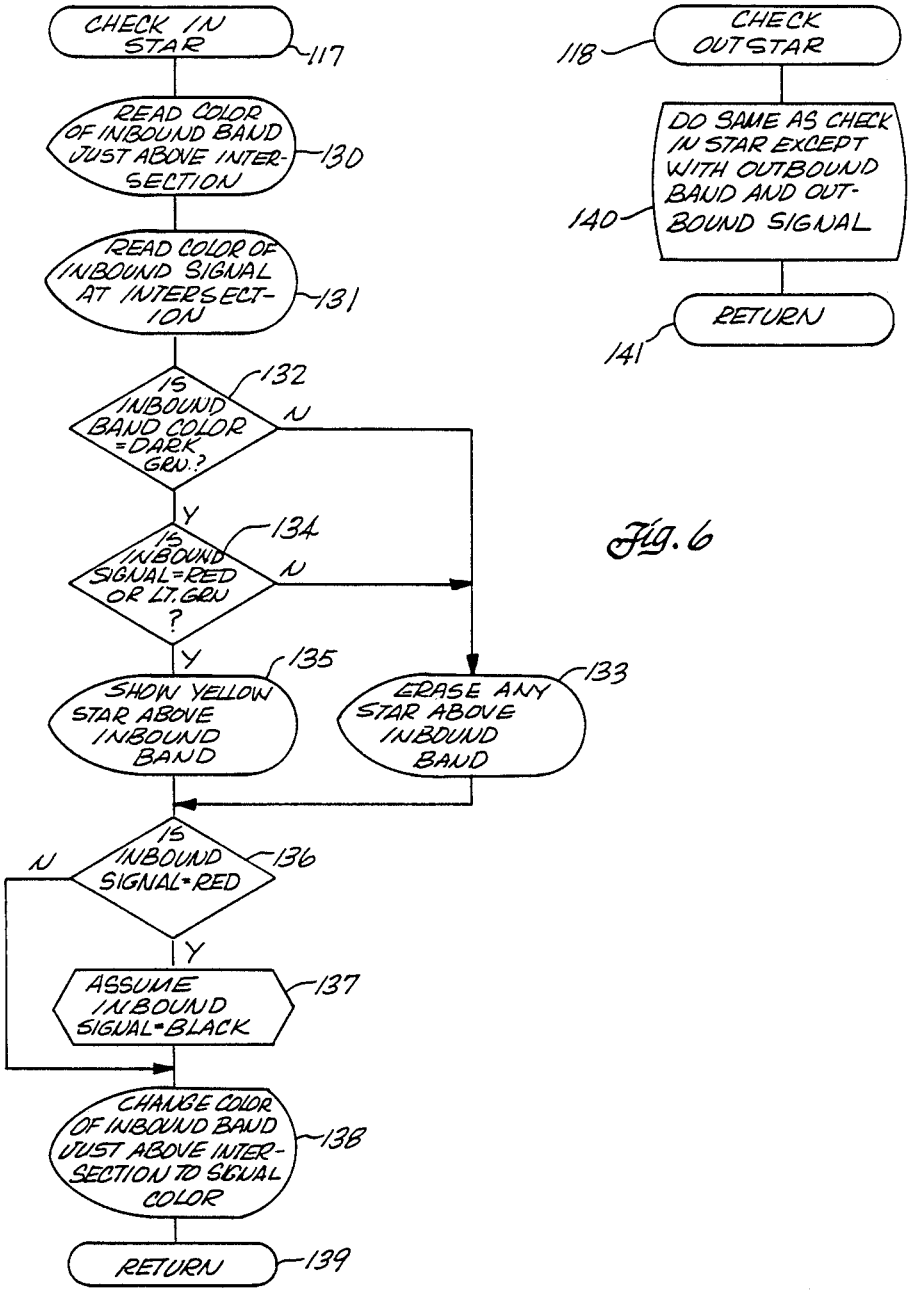

FIG. 6 illustrates the "check-in star" and "check-out star" routines. As represented by a block 130, the previous status in the display band (42 or 44) adjacent the selected intersection is read. As represented by a block 131, the current status at the selected intersection is read. As represented by a block 132, a determination is made as to whether the previous status in the display band is through green. If not, as represented by block 133, any star adjacent to the selected intersection is erased. If so, as represented by a block 134, a determination is made whether the current status at the selected intersection is red or local green. If not, again as represented by block 133, any star at the intersection is erased. If so, as represented by a block 135, a star is produced on the display. Thus, in effect, blocks 132 and 134 compare the previous status with the current status, producing a star responsive to a discrepancy in the comparison when the previous status is through green, and erasing any previously produced star under all other circumstances. As represented by a block 136, a determination is made whether the current status at the selected intersection is red. If so, as represented by a block 137, the color red is converted to the color black for the purpose of display in band 42. As represented by a block 138, the color in band 42 directly adjacent the selected intersection is changed to the color at the selected intersection. As represented by a block 139, there is then a return to the routine illustrated in FIG. 5. As represented by a block 140, the steps represented in blocks 130 to 138 are repeated with respect to the outbound band and traffic signals at the intersections upon branching to the "check-out star" routine. Thereafter, as represented by a block 141, there is a return to the routine represented in FIG. 5.

To summarize, the described program performs the following operations at each sampling interval:

(1) request current status (color) from each traffic signal;

(2) shift the previous status data (color) in the display bands seven or eight pixels in the direction of traffic flow and execute steps 4 and 5 after each pixel move;

(3) update the current status (color) of each traffic signal;

(4) compare the updated current status (color) at each intersection with the previous status in the display band adjacent the intersection;

(5) update the star status at the intersection, depending upon the comparison—producing a star if there is a discrepancy in the comparison, i.e., the previous status is through green and the current is not, and erasing a star under all other conditions;

(6) update the data (color) in the display bands adjacent the intersections to correspond to the current status (color) at the intersection (7) repeat the process every sampling interval.

The described embodiment of the invention is only considered to be preferred and illustrative of the inventive concept; the scope of the invention is not to be restricted to such embodiments. Various and numerous other arrangements may be devised by one skilled in the art without departing from the spirit and scope of this invention. For example, although it is advantageous to display the previous and current statuses as colors corresponding to the colors of the traffic signal intervals, these statuses could be displayed in the form of shapes, numbers, letters, etc. Although it is advantageous to display local green and through green separately, valuable information can also be displayed utilizing principles of the invention without distinguishing between through green and local green. Valuable information can also be displayed without making the comparison between current status and previous status adjacent the intersections and without displaying a representation of a discrepancy, e.g., a star, as disclosed. The principles of the invention can also be utilized in two intersecting, i.e. two-dimensional, traffic systems. Although the invention will ordinarily be practiced by a real-time display, the display can also be time shifted by recording the data on video tape or in binary digital form.

Attached hereto is a listing for a program in BASIC and MACHINE language for carrying out the steps represented in FIGS. 3 to 6 on an IBM Personal Computer.

What is claimed is:

1. A method of displaying the status of a system of traffic signals comprising the steps of:

(a) repeatedly monitoring the status of the traffic signals;

(b) presenting a visual display of the spatial arrangement of the traffic signals in the system;

(c) repeatedly representing on the display the currently monitored status of the traffic signals spatially coordinated with the display of the respective traffic signals; and (d) repeatedly representing on the display a plurality of previously monitored statuses spatially coordinated with the display of the respective traffic signals and a traffic speed representation between the respective traffic signals.

2. The method of claim 1, in which step (a) distinguishes between a through green status and a local green status and step (d) represents previously monitored statuses as through green or local green.

3. The method of claim 2, in which the traffic speed representation is a designed progression speed of the system in a given direction through the system, step (b) represents the traffic signals as marks in a horizontal row, step (c) represents the currently monitored status by the color of the marks, and step (d) represents the previously monitored statuses adjacent to the row as an at least two colored horizontal band that moves between the marks in the given direction at a speed proportional to the progression speed in the given direction.

4. The method of claim 3, in which the system has a designed progression speed through the system in the direction opposite the given direction and step (d) further represents the previously monitored statuses adjacent to the horizontal row as an at least two colored horizontal band that moves between the marks in the opposite direction at a speed proportional to the progression speed in the opposite direction.

5. The method of claim 3, additionally comprising the steps of comparing the currently monitored status of each traffic signal with the previously monitored status represented in the band directly adjacent to the mark representing such traffic signal, and representing as a separately distinguishable mark a discrepancy in the comparison when said previously monitored status is through green.

6. The apparatus of claim 1 in which the monitoring means comprises means for distinguishing between a through green status and a local green status, and the representing means represents previously monitored statuses as through green or local green.

7. A method for graphically illustrating improper coordination of an arterial traffic control system having a plurality of traffic signals, the method comprising the steps of:

repeatedly monitoring the statuses of the traffic signals;

presenting a visual display of the current statuses of the traffic signals in the system;

storing the monitored statuses of the traffic signals;

comparing a currently monitored status of each traffic signal with a previously monitored status representative of the transit time from an adjacent traffic signal at a designed progression speed; and representing on the display a mark spatially coordinated with the display of respective traffic signal when there is a discrepancy in the comparison.

8. The method of claim 7, in which the monitoring step distinguishes between a through green status and a local green status and the comparing step determines discrepancies between the previous status and the current status when the previous status is through green.

9. In a traffic control system having intersection traffic signal controllers and an arterial master progression coordinator in part controlling the intersection traffic signal controllers, apparatus for displaying the status of traffic signals comprising:

means for monitoring the status of the traffic signals;

a visual display device;

means for presenting on the display device a spatial arrangement of the traffic signals in the system;

means for repeatedly representing on the display the currently monitored status of the traffic signals spatially coordinated with the display of the respective traffic signals; and means for repeatedly representing on the display a plurality of previously monitored statuses spatially coordinated with the respective traffic signals and a traffic speed representation between the respective traffic signals.

10. A method of displaying the status of a system of traffic signals comprising the steps of:

presenting a visual display of the spatial arrangement of the traffic signals along an arterial line in the system;

presenting a display band of traffic signal statuses parallel to the arterial line;

requesting the current status from each traffic signal at each sampling interval;

entering the current status data from each traffic signal into the display band adjacent to the presentation of such traffic signal on the arterial line at each sampling interval; and shifting the previous status data in the display band a predetermined distance in the direction of traffic flow at each sampling interval.

11. The method of claim 10, additionally comprising the steps of:

comparing at each sampling interval the current status data at each traffic signal with the previous status data in the display band adjacent to such traffic signal; and placing a mark on the display near the presentation of each traffic signal if there is a discrepancy in the comparison and erasing any previously placed mark near the presentation if there is no discrepancy.

* * * * *